United States Patent [19]

Hattori et al.

[11] Patent Number: 4,754,952

[45] Date of Patent: Jul. 5, 1988

[54] FLUIDIZED-BED TYPE CARBURIZING FURNACE MEANS FOR USE AS BRIGHT HEAT-TREATING FURNACE

[75] Inventors: Hisashi Hattori; Yoichiro Hanada; Tatsu Fukuda, all of Hirakata, Japan

[73] Assignee: Kabushiki Kaisha Komatsu Seisakusho, Tokyo, Japan

[21] Appl. No.: 814,435

[22] Filed: Dec. 30, 1985

[51] Int. Cl.[4] ..... C21D 9/00

[52] U.S. Cl. ..... 266/80; 266/81; 266/90; 266/252

[58] Field of Search ..... 266/249, 250, 252, 78, 266/80, 81, 90; 432/58; 417/151, 158

[56] References Cited

U.S. PATENT DOCUMENTS

| | | | |
|---|---|---|---|
| 165,651 | 7/1875 | Goodsell | 417/151 |
| 1,517,764 | 12/1924 | Still | 417/158 |
| 2,620,967 | 12/1952 | Worn | 417/158 |
| 2,952,401 | 9/1960 | Wright | 417/151 |
| 3,342,649 | 9/1967 | Morgan | 748/16 |
| 3,448,917 | 6/1969 | Dewey et al. | 417/151 |
| 3,718,024 | 2/1973 | Vitelli | 72/201 |
| 4,512,821 | 4/1985 | Staffin et al. | 148/16.5 |
| 4,602,769 | 7/1986 | Crum | 266/259 |

OTHER PUBLICATIONS

Perry Chemical Engineer's Handbook, pp. 6-28 to 6-30, © 1963, 4th edition.

*Primary Examiner*—Christopher W. Brody
*Attorney, Agent, or Firm*—Armstrong, Nikaido, Marmelstein & Kubovcik

[57] ABSTRACT

Fluidized-bed type carburizing furnace means of the class provided with a path for circulation of the furnace gas of a fluidized-bed type carburizing furnace is improved by incorporation therein of ejector means for spouting compressed gas into the circulation path. The circulation path comprises an outlet pipe emanating from the furnace gas outlet of the fluidized-bed type carburizing furnace, a cyclone connected through the medium of the outlet pipe to the fluidized-bed type carburizing furnace, and a discharge pipe emanating from the cyclone and joined to the furnace gas inlet of the fluidized-bed type carburizing furnace. The ejector means comprises a constriction formed in the discharge pipe and a feed pipe for compressed gas having the leading end thereof inserted into the constriction.

4 Claims, 1 Drawing Sheet

FLUIDIZED-BED TYPE CARBURIZING FURNACE MEANS FOR USE AS BRIGHT HEAT-TREATING FURNACE

BACKGROUND OF THE INVENTION

1. Field of the Invention

This invention relates to a bright heat-treating furnace, and more particularly to fluidized-bed type carburizing furnace means to be used as a bright heat-treating furnace.

2. Description of the Prior Art

As a furnace for bright heat treatment, the carburizing furnace means composed of a pair of fluidized-bed type furnaces, one for bright hardening and the other for bright tempering, which is disclosed as in Japanese Patent Publication No. SHO 60(1985)-43,409 (applicant for patent: KABUSHIKI KAISHA KOMATSU SEISAKUSHO.) has been available for actual use.

In the conventional carburizing furnace means, the furnace gas (such as, for example, $N_2$ gas or some other atmospheric gas) used for fluidization in the bright hardening furnace is introduced through piping means into the bright tempering furnace, wherein the heat released from the furnace gas is utilized for the purpose of tempering. The furnace gas which has been introduced into the bright tempering furnace and consequently deprived of heat is passed through piping means and returned to the bright hardening furnace by means of a blower or fan disposed in the piping means.

By circulating the furnace gas in the manner described above, recycling of the heat and the composition of the furnace gas and stabilization of the conditions of the furnace gas in the two furnaces are attained.

In the conventional carburizing furnace means described above, since the fan which is used for the circulation of the furnace gas has no heat-resisting property, the furnace gas departing from the heating furnace must be cooled to a prescribed temperature. This furnace means, therefore, inevitably entails the poor economy that both the furnaces are required to be kept in operation even when no use is found for the treatment of tempering.

The conventional bright heat-treating furnace of another class using only a heating furnace has the disadvantage that, for the purpose of lowering the temperature of the furnace gas, the furnace is inevitably required to be provided with a large heat exchanger.

Further, where a mixture of nitrogen gas with an alcohol is used as the gas for fluidization, there is the possibility that soot deposits on the internal wall surface of the pipe laid between the outlet of the heat exchanger and the fluidized-bed gas dispersion plate in the carburizing furnace. If the alcohol content of this mixture is decreased for the purpose of preventing this deposition of soot, there ensues the disadvantage that desired stabilization of the internal gas of the furnace is no longer obtained. Solution of this problem necessitates additional incorporation in the furnace of a gasifier for the alcohol. Moreover, the fan used in this furnace is required to be made of a material highly resistant to heat.

SUMMARY OF THE INVENTION

This invention has been produced with a view to remedying the drawbacks suffered by the conventional furnace means as described above. It aims to provide a fluidized-bed type carburizing furnace means constructed so as to enable efficient circulation of the furnace gas without relying on a heat exchanger or an alcohol gasifier, permit saving of energy and economization of such atmospheric gas as $N_2$ gas and an alcohol added thereto, and ensure stabilization of the internal gas of the furnace.

To accomplish the object described above, according to the present invention, there is provided fluidized-bed type carburizing furnace means furnished with a path for circulation of the furnace gas of a fluidized-bed type carburizing furnace, which fluidized-bed type carburizing furnace means comprises ejector means for spouting a compressed gas into said circulation path.

This invention provides as one embodiment thereof fluidized-bed type carburizing furnace means which further comprises a tank for storage of alcohol to be fed to the fluidized-bed type carburizing furnace.

This invention provides as another embodiment thereof fluidized-bed type carburizing furnace means wherein the path for circulation of the furnace gas comprises an outlet pipe emanating from the furnace gas outlet of the fluidized-bed type carburizing furnace, a cyclone connected through the medium of the outlet pipe to the fluidized-bed type carburizing furnace, and a discharge pipe emanating from the cyclone and joined to the furnace gas inlet of the fluidized-bed type carburizing furnace.

This invention further provides as still another embodiment thereof fluidized-bed type carburizing furnace means wherein the ejector means comprises a constriction formed in the discharge pipe and a feed pipe for compressed gas having the leading end thereof inserted into the constriction.

This invention provides as yet another embodiment thereof fluidized-bed type carburizing furnace means wherein the supply of the alcohol to the fluidized-bed type carburizing furnace is regulated by sampling the furnace gas at prescribed intervals 20 to 100 mm above the upper surface of the fluidized bed, analyzing the samples for CO—$CO_2$ or O content, and controlling a switch valve inserted in a pipe interconnecting the tank and the fluidized-bed type carburizing furnace thereby allowing the numerical value of the content to remain at a prescribed level.

The other objects, advantages, and characteristic features of the present invention will become apparent to those skilled in the art as the disclosure is made in the following description of a preferred embodiment of the invention, as illustrated in the accompanying drawings.

DETAILED DESCRIPTION OF THE INVENTION

Figure 1:
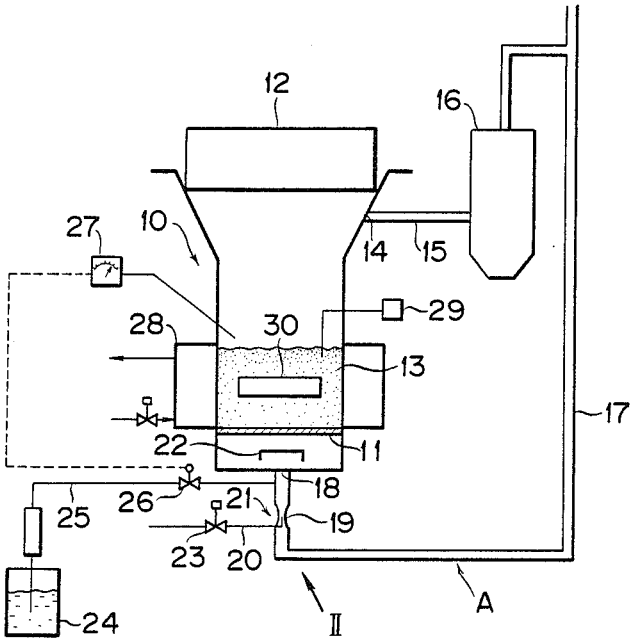
FIG. 1 is a schematic explanatory diagram of a typical fluidized-bed type carburizing furnace means as one preferred embodiment of this invention.
Figure 2:
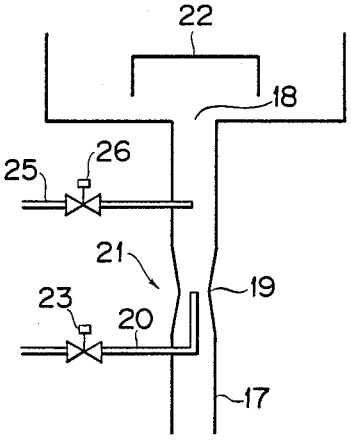
FIG. 2 is a magnified diagram of the portion II of FIG. 1.

Now, a preferred embodiment of this invention will be described below with reference to the accompanying drawings.

A fluidized-bed type carburizing furnace 10 is provided therein with a gas dispersion plate 11. It is covered at the top thereof with a lid 12 and furnished therein with a fluidized bed 13 of particles formed on the gas dispersion plate 11. An outlet 14 for the furnace gas of the fluidized-bed type carburizing furnace 10 is connected through the medium of an outlet pipe 15 to the inlet side of a cyclone 16. A discharge pipe 17 emanates from the outlet side of the cyclone 16. The discharge pipe 17 is extended and connected to a furnace gas inlet 18 of the fluidized-bed type carburizing furnace 10. The pipes mentioned above jointly form a circulation path A. The discharge pipe 17 has a constriction 19 formed therein. The leading end of a feed pipe 20 for compressed air or compressed nitrogen gas is inserted in this constriction 19. The feed pipe 20 and the discharge pipe 17 jointly form an ejector 21. A baffle plate 22 is interposed between the gas dispersion plate 11 and the furnace gas inlet 18. The feed pipe 20 has a valve 23 inserted therein. The ejector 21 and the baffle plate 22 are made of an alloy resistant to heat. A tank 24 is used for supply of alcohol. An output pipe 25 emanating from the tank 24 has the leading end thereof open into the outlet side of the ejector 21. The output pipe 25 is provided therein with a valve 26 which is adapted to be switched by the signal from a $CO/CO_2$ analyzer 27. The tank 24 is adapted to admit therein compressed air.

A burner heater 28 is adapted to be supplied with fuel and air. A thermocouple 29 is disposed so as to measure the temperature of the fluidized bed. A workpiece 30 subjected to heat treatment is disposed as submerged in the fluidized bed 13.

Now, the operation of the fluidized-bed typ carburizing furnace means of this invention will be described below.

The furnace gas discharged from the fluidized-bed type carburizing furnace 10 is deprived of entrained dust during passage through the cyclone 16. Part of the furnace gas is suctioned by the ejector 21 and returned into the fluidized-bed type carburizing furnace 10.

The alcohol is added to the outlet side of the ejector 21, abruptly vaporized by the compressed gas spouted by the ejector 21, and led into the fluidized-bed type carburizing furnace 10.

The pressure released from the ejector 21 is 1,000 mmAq and the pressure of the compressed gas spouted out of the tip of the feed pipe 20 at the center of the ejector 21 is in the range of 5 to 15 $kg/cm^2$. The flow volume of the furnace gas suctioned from the cyclone 16, therefore, falls in the range of 1 to 4 based on the flow volume of the compressed gas taken as unity. Thus, 50 to 80% of the heat of the furnace gas from the fluidized bed 13 and the gas itself can be circulated and the amount of the compressed gas to be consumed is only 20 to 50% of the amount of the compressed gas otherwise consumed where the furnace means is devoid of the ejector 21 and is not allowed to circulate the gas.

Generally in the conventional countertype which is not provided with the ejector 21, about 12% of the amount of heat supplied to the fluidized-bed type carburizing furnace 10 is discharged through the cyclone. When the furnace gas is circulated by virtue of the ejector 21, the proportion of the amount of heat so discharged through the cyclone is decreased to the order of 3 to 6%.

The alcohol begins to decompose itself in the fluidized bed. This decomposition proceeds so slowly that there occurs a difference between the atmosphere in the upper part and that in the lower part respectively of the fluidized bed 13. When the furnace gas is circulated by virtue of the ejector 21, however, the difference in the atmosphere is less than 50% of the difference experienced in the absence of the circulation of the furnace gas.

The amount of the alcohol to be supplied is regulated by sampling the furnace gas at prescribed intervals 20 to 100 mm above the upper surface of the fluidized bed 13, analyzing the samples for $CO/CO_2$ or O content, and controlling the valve 26 thereby allowing the numerical value of the aforementioned content to remain at a prescribed level.

The fluidized-bed type carburizing furnace 10 is operated at a fluidized bed temperature in the range of 200° to 1,100° C. As the gas for the formation of the fluidized bed, air is used for atmospheric heating and nitrogen gas or a mixture of nitrogen gas with alcohol is used for ambient heating and carburization.

Optionally, the fluidized-bed type carburizing furnace means may be utilized for carbonitriding or nitriding a given work by introducing ammonia gas in conjunction with the alcohol into the furnace.

Owing to the incorporation of the ejector means, the fluidized-bed type carburizing furnace means of this invention notably economizes the compressed gas, greatly decreases the waste of the furnace gas through the cyclone, and amply reduces the difference of atmosphere in the upper and lower parts of the fluidized bed.

Obviously, many modifications and variations of the present invention are possible in light of the preceding teachings. It is therefore to be understood that within the scope of the appended claims, the present invention may be practised otherwise than as specifically described herein.

What we claim is:

1. Fluidized-bed type carburizing furnace system including a fluidized-bed type carburizing furnace having a path for circulation of furnace gas, said path comprising an outlet pipe emanating from a furnace gas outlet of said furnace, a cyclone connected to said outlet pipe, and a discharge pipe emanating from said cyclone and joined to a furnace gas inlet of said furnace; ejector means in said path positioned adjacent said furnace gas inlet for spouting a compressed gas into said circulation path, said ejector means comprising a constriction formed in said discharge pipe and a feed pipe for compressed gas having a leading end, said leading end being inserted into said constriction; and means for supplying alcohol directly to said furnace including an output pipe, said output pipe having an end positioned in said circulation path between said ejector means and said furnace gas inlet.

2. Fluidized-bed type carburizing furnace system according to claim 1, wherein said means for supplying further comprises a tank for storage of alcohol to be fed to said fluidized-bed type carburizing furnace and means for feeding alcohol from said tank to said output pipe.

3. Fluidized-bed type carburizing furnace system according to claim 2, wherein said means for supplying alcohol to said fluidized-bed type carburizing furnace further comprises means for sampling said furnace gas at prescribed intervals 20 to 100 mm above the upper surface of said fluidized bed, means for analyzing the samples for $CO/CO_2$ or O content, a switch valve inserted in a pipe interconnecting said tank and said fluidized-bed type carburizing furnace and means for controlling said switch valve to keep the numerical value of said content at a prescribed level.

4. Fluidized-bed type carburizing furnace system according to claim 1, further comprises means for feeding compressed air or nitrogen gas to said feed pipe.

* * * * *